United States Patent [19]

Krüger et al.

[11] 4,324,264

[45] Apr. 13, 1982

[54] BOTTLE CLEANING MACHINE

[75] Inventors: Roland Krüger; Joachim Ciongwa, both of Dortmund; Günther Smusch, Werne; Klaus Ehrlinger, Holzwickede, all of Fed. Rep. of Germany

[73] Assignee: Holstein und Kappert GmbH, Dortmund, Fed. Rep. of Germany

[21] Appl. No.: 144,436

[22] Filed: Apr. 28, 1980

[30] Foreign Application Priority Data

Apr. 27, 1979 [DE] Fed. Rep. of Germany ..... 2917065

[51] Int. Cl.[3] ..... B08B 3/02

[52] U.S. Cl. ..... 134/68; 134/152; 118/324; 118/422; 198/482

[58] Field of Search ..... 134/66–68, 134/73, 83, 127, 152; 198/482, 342; 118/324, 422

[56] References Cited

U.S. PATENT DOCUMENTS

| | | | |
|---|---|---|---|
| 813,012 | 2/1906 | Loew | 134/67 X |
| 813,100 | 2/1906 | Loew | 134/68 |
| 3,951,158 | 4/1976 | Tedden | 134/73 X |
| 4,009,301 | 2/1977 | Heckman et al. | 118/324 X |

FOREIGN PATENT DOCUMENTS

| | | | |
|---|---|---|---|
| 439622 | 1/1927 | Fed. Rep. of Germany | 134/68 |
| 3107 | of 1913 | United Kingdom | 134/67 |

*Primary Examiner*—Robert L. Bleutge

*Attorney, Agent, or Firm*—Toren, McGeady & Stanger

[57] ABSTRACT

In a bottle cleaning operation, bottles to be cleaned are introduced into a machine housing divided into a first housing and a separate second housing intercommunicating with one another through a bottle transfer section. Bottles are introduced into carrier compartments mounted on a first endless circulating chain in the first housing. After undergoing certain cleaning procedures in the first housing, the bottles are transferred into the second housing with the bottles passing in a free-falling manner from the first circulating chain. Within the second housing the cleaning operation is continued with the bottles held in carrier compartments on a second endless circulating chain. After being treated within the second housing, the bottles free-fall from the second circulating chain and return into the first housing for completing the cleaning operation before the bottles are discharged from the first housing.

12 Claims, 7 Drawing Figures

BOTTLE CLEANING MACHINE

SUMMARY OF THE INVENTION

The present invention is directed to a machine for cleaning bottles with the machine divided into several separate treatment sections. As they pass through the treatment sections, the bottles are emptied of any residue, and then are subjected to presoaking, main soaking and clear rinsing treatments. The bottles are held in carrier compartments attached to circulating chains as they pass from an inlet station to an outlet station of the machine.

Fully automatic machines used in cleaning reusable bottles, are formed of several treatment sections through which the bottles pass held within compartments. Before the actual cleaning procedure is commenced, the bottles are emptied of any residue and are sprayed for removing coarse and loose impurities and to institute at the same time a certain rise in temperature. Subsequently, the bottles are soaked, with the removal of any impurities taking place within a lye soaking zone. In elongated cleaning machines this zone is regarded as the largest treatment section. After the soaking operation, the bottles are sprayed several times with a lye solution after having been immersed for removing any labels attached to the bottle exterior. Subsequently, the bottles are sprayed with warm water and then with fresh water in the warm water section.

During such treatment the bottles are held in bottle baskets or compartments attached to endless chains. Preferably, the bottles are moved continuously through the various treatment sections. This method of transporting the bottles, generally used in present day heavy-duty machines, involves certain disadvantages which require considerable counter-measures.

Since the bottle baskets or compartments are formed of plastics material, a considerable carry-over of lye takes place from the lye zones preceding the final cleaning operations because of the large surfaces of the baskets including the lining. Because of this carry-over, a continuous source of alkalinity passes from the lye treating sections into the warm water section. Accordingly, boiler scale deposits are formed from the lime dissolved in the water and such deposits may impair the warm water spraying operation. Not only is there a mechanical impairment of the warm water section, but problems also result from a microbiological standpoint. The rough surfaces of the lime deposits form ideal breeding grounds for microorganisms which are promoted by the temperatures in the range of 30° to 40° C. as well as the slightly alkaline environment.

Another disadvantage experienced has been the heat content of the bottle baskets or compartments which are heated in the lye treatment section to about 80° with the heat content being carried over into the warm water section where it influences the heat balance. Because of this heat carry-over factor, an additional effort is required to reduce the temperature in the warm water section to that of the draining waste water.

Therefore, it is the primary object of the present invention to overcome the problems experienced in the known cleaning machines by providing a machine in which there is a continuous transport of the bottles in carriers or baskets attached to an endless circulating chain so that there is no negative influence on the succeeding treatment sections by the preceding sections. In this cleaning machine the difficult reloading of the bottles for effecting their movement from one transport direction to another is avoided with the transfer of the bottles being accomplished in a free-falling manner.

In accordance with the present invention, the housing of the cleaning machine is divided into a first housing and a second housing intercommunicating through a transfer section. A separate endless circulating chain is provided in each housing with the chains being arranged so that the bottles being transferred between the housings pass from one to the other in a free-falling manner. A special advantage of this cleaning machine involves a complete separation of the different treatment sections while it is still possible to use the baskets and chains required for continuous circulation in heavy-duty cleaning machines. The carry-over of lye, as mentioned above, unavoidable in known machines, can be eliminated in the cleaning machine of the present invention. Additionally, the heat content carry-over of the materials used in the bottle carrier compartments is insignificant because the temperatures specific to each separate housing are maintained and there is no contact between the differently heated carrier compartments located in the separate housings.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
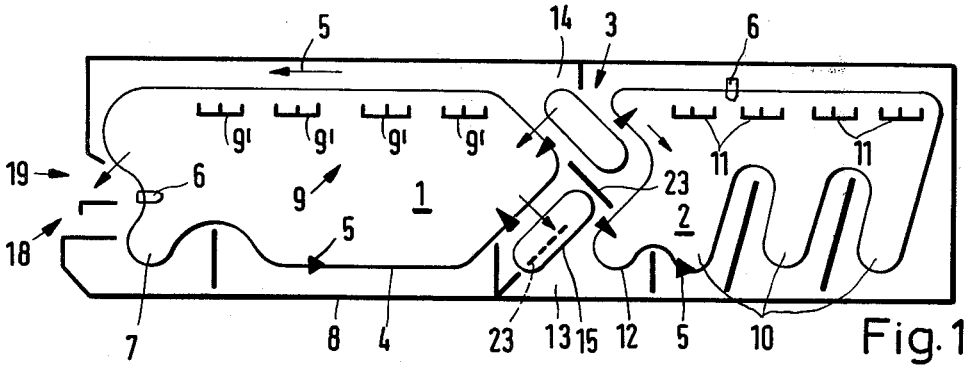
FIGS. 1 to 7 are schematic illustrations of a number of different embodiments of the present invention.

In the embodiment shown in FIG. 1, the housing of the cleaning machine is divided into two separate treatment housings 1, 2 with a transfer area or section 3 intercommunicating between the two housings. An endless chain 4 is located within treatment housing 1 and passes through a number of different treatment sections or zones. Arrow 5 indicates the direction of movement of the endless chain 4 and bottle carrier compartments 6 are located on the chain extending transversely of its direction of movement. The bottle carrier compartments 6 are located close together and each carrier compartment forms an individual bottle basket. Treatment housing 1 contains all of the low temperature treatment sections, that is, section 7 for draining residue and prespraying, section 8 for presoaking, and warm water section 9 which contains various rinsing and clear rinsing sections 9'.

Second treatment housing 2 contains the high temperature treatment sections including lye treatment sections 10 and lye spraying sections 11. A second endless chain 12 is located within the second housing 2 and is independent of the first chain 4 in the first housing 1. Bottle baskets or carrier compartments 6 are also located on the second chain 12 in the same manner as on the first chain 4. The cleaning machine shown in FIG. 1 is a single-end machine. Intercommunicating between the first and second housings is the transfer section 3 having a lower transfer section 13 and an upper transfer section 14. Each of the upper and lower transfer sections 13, 14 has an auxiliary chain 15 with the auxiliary chain extending in parallel with the corresponding adjacent portions of the endless chains 4, 12 within the first and second housings 1, 2. The auxiliary chains 15 transfer the bottles between the first housing 1 and the second housing 2. The portion of the chains 4, 12 extending along and parallel with the auxiliary chain 14 are inclined in such a manner, or are guided horizontally, so that the bottles experience a free-fall in moving between the chains 4, 12 and the auxiliary chain 15. Since the bottles free-fall from one chain to another no auxiliary means are required for effecting the transfer. For the purpose of effecting transfer, sliding areas for the transfer of bottles are provided between the portions of the chains which extend obliquely so that, for practical purposes, a silent sliding or transfer of the bottles is assured. In the embodiment shown in FIG. 1, both of the chains 4, 12 are utilized in the lower and upper transfer sections 13, 14 for passing the bottles between the first and second housings.

Figure 3:
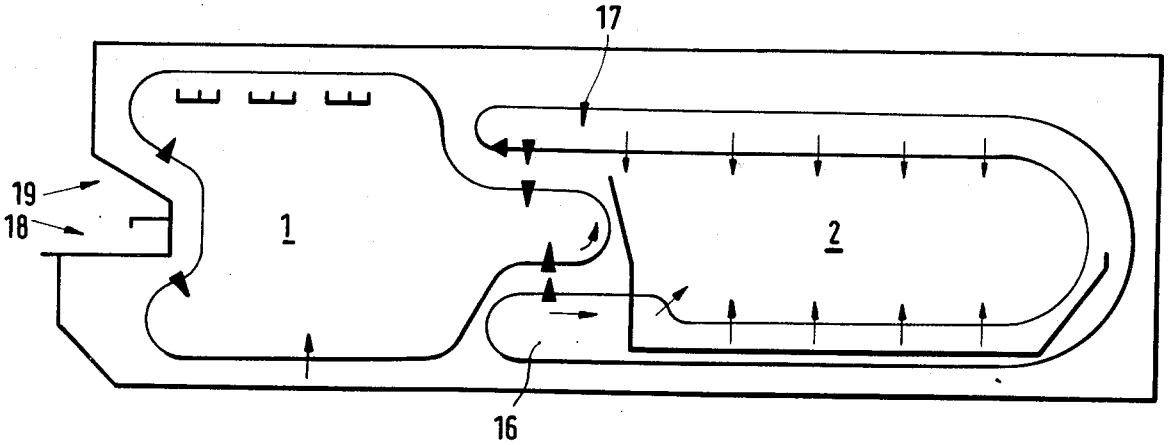

In FIG. 3 a single-end cleaning machine is illustrated, note the inlet 18 and the outlet 19 at one end of the machine housing so that only a portion of the chain within the second housing 2 is utilized in cleaning the bottles. As in the embodiment shown in FIG. 1, the machine is divided into a first housing 1 and a second housing 2 forming a low temperature section and a high temperature section, respectively. In the transfer section 3 a pair of horizontally extending loops 16, 17 of the chain in the second housing 2 are located opposite a loop on the chain in the first housing. Accordingly, bottles are transferred from the chain in the first housing to the loop 16 and, after passing through the second housing 2, are returned from the loop 17 onto the chain in the first housing. The transfer of bottles between the two housings is effected without any auxiliary chains 15.

Figure 2:
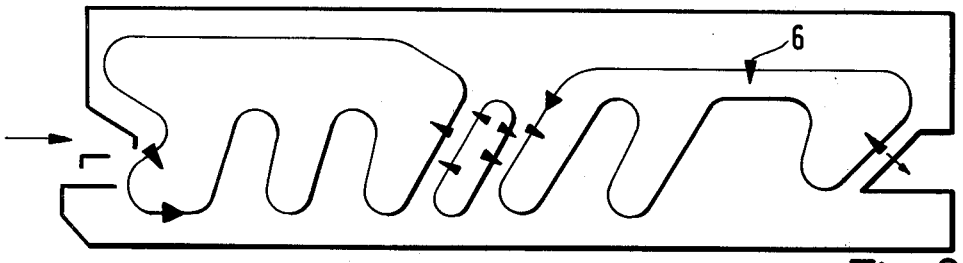
Figure 4:
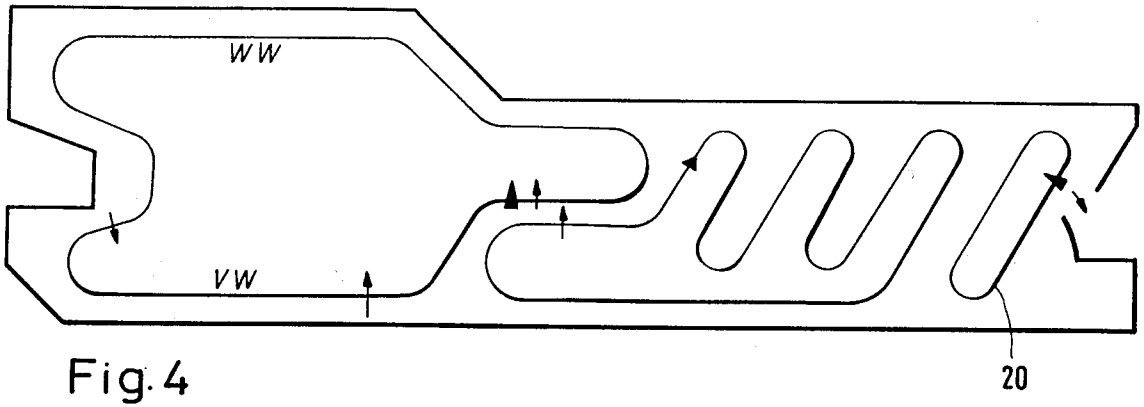
Figure 5:
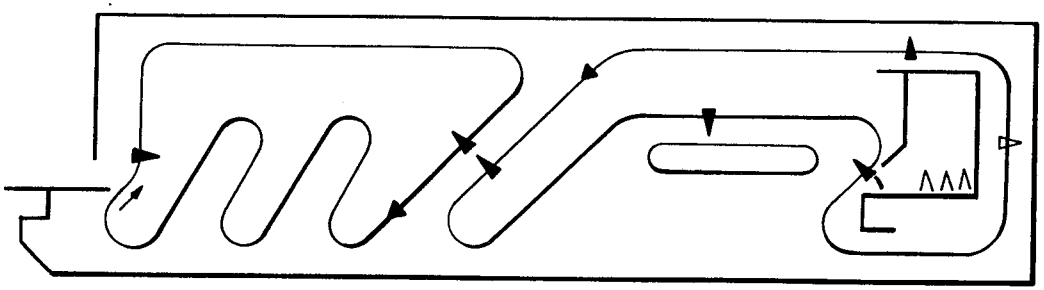

Other embodiments of the cleaning machine are shown in FIGS. 2, 4 and 5. In these embodiments the inlet 18 and the outlet 19 are located at the opposite ends of the machine housing. Further, the high temperature zone and low temperature zone are separated from one another within the housing. In FIG. 2 the bottles enter the inlet at the left-hand end traversing the first portion of the housing where the bottles are transferred to an auxiliary chain separating the two temperature zones with the auxiliary chain delivering the bottles onto the chain in the right-hand end for further treatment before passing to the outlet at the right-hand end of the machine housing.

In FIG. 4, portions of the chains in the two housing sections extend in parallel relation so that no auxiliary chain is required. Bottles pass from the left-hand chain to the right-hand chain and then to an auxiliary outlet chain 20 which delivers the cleaned bottles to the outlet from the housing.

In FIG. 5, another arrangement is shown somewhat similar to that in FIG. 4, however, the outlet auxiliary chain is eliminated with the outlet section being bypassed by an empty portion of the chain 12 in the right-hand end of the machine housing.

Figure 6:
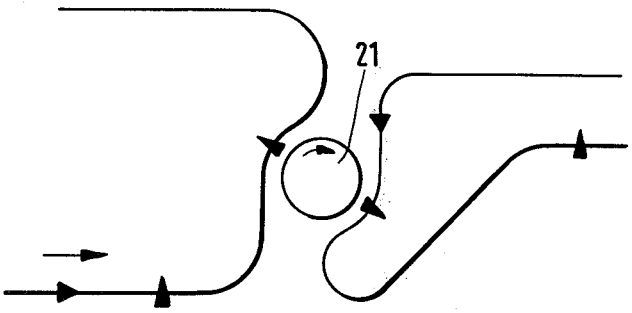
Figure 7:
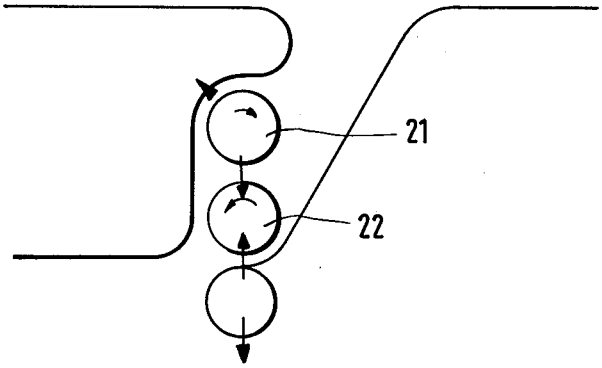

In FIGS. 6 and 7 another arrangement of the transfer section is shown where instead of auxiliary chains 15 or corresponding portions of the main chains extending parallel to one another, bottle compartment barrels 21, 22 are used for transferring the bottles. When such compartment barrels are used, a sufficient area, with respect to time and length, is provided for the transfer of the bottles from one housing 1 to the second housing 2.

Using the embodiment shown in FIG. 1, the following is a description of the flow of bottles through the cleaning machine. Bottles are introduced into the machine at the inlet 18 entering the carrier compartments 6 as the chain 4 moves continuously through the first housing 1. Initially, the bottles pass through the section 7 where any residue is drained. Any remaining liquids are removed and coarse impurities are sprayed out. In the next section 8 on the lower run of the chain 4 presoaking takes place. After passing through the presoaking section 8, the carrier compartment 6 with the bottles enter the transfer section 3 with the chain 4 being inclined in such a way to guarantee that the bottles slide out of the carrier compartments on the chain 4 into corresponding compartments on the auxiliary chain 15. Chain 15 is in parallel alignment with and moves at the same speed as the chain 4. The bottles are introduced into the carrier compartments on the auxiliary chain 15 with their bottoms entering first and, subsequently, the bottles are deflected from auxiliary chain 15 to the carrier copartments on the chain 12. The portions of the auxiliary chain 15 and the chain 12 which effect the transfer are in parallel relation and move in the same direction. In the freely guided section of the auxiliary chain 15 in the transfer section 3, support plates 23 are arranged which prevent the bottles from sliding out of the carrier compartments. When the bottles are received in the carrier compartments of the chain 12, they pass into the second housing 2 and enter into the lye bath section 10. By means of appropriate loop arrangements of the chain, the bottles pass through various baths and eventually reach a number of lye spraying sections 11 with the bottles having had their labels removed in the meantime. After completing the passage through the lye spraying section 11, the bottles are transferred from the carrier compartments in the chain 12 to the corresponding compartments in the upper auxiliary chain 15 and then into the carrier compartments in the chain 4 in the first housing 1. Accordingly, having exited from the high temperature section within the second housing 2, the bottles enter the warm water section 9 in the first housing 1 where they pass through further rinsing and clear rinsing sections 9' before finally sliding out of the carrier compartments at the outlet 19 where they move onto a discharge conveyor.

The treatment in the embodiments shown in FIGS. 2 to 7 proceeds in the same manner. The various treatment sections and the guidance of the chains can be designed differently depending on the requirements involved. For this reason not all of the cleaning treatment operations are shown and, consequently, the required chain guidance through the different sections are reproduced in a simplified manner in these embodiments.

While specific embodiments of the invention have been shown and described in detail to illustrate the application of the inventive principles, it will be understood that the invention may be embodied otherwise without departure from such principles.

What is claimed is:

1. Machine for cleaning bottles containing several treatment sections for cleaning the bottles of residue and for subjecting the bottles to presoaking, main soaking, and clean rinsing, comprising a machine housing having an inlet for introducing bottles to be cleaned and an outlet for discharging cleaned bottles from said machine housing, circulating chains located within said machine housing for conveying the bottles from the inlet to and through the treatment sections and then to the outlet, and means located on said circulating chains for carrying individual bottles, wherein the improvement comprises that said machine housing comprises a first housing, a second housing and a transfer section intercommunicating said first and second housings for passing bottles therebetween with said first and second housings being completely separate from one another and spaced apart by said transfer section, said circulating chains comprise a first endless chain located within said first housing, a second endless chain located within said second housing, said first and second chains being arranged to circulate continuously and being separate from one another with a portion of each of said first and second chains moving through said transfer section, said means for carrying individual bottles comprising separate carrier compartments mounted on each of said first and second chains, said first and second chains positioned at said transfer section with said carrier compartments on said first and second chains disposed in spaced relation so that bottles supported in said carrier compartments thereon can be transferred in a free-falling manner passing between said first and second chains, and each of said first and second chains having a lower section and an upper section spaced vertically above said lower section.

2. Machine, as set forth in claim 1, including means in said transfer section for transferring bottles between said first and second chains.

3. Machine, as set forth in claim 1, wherein said first housing being arranged for the low temperature treatment sections and said second housing being arranged for the high temperature treatment sections and the lye treatment sections.

4. Machine, as set forth in claim 1, wherein said first housing having a residue removing section, a presoaking section, a rinsing section and a clear rinsing section.

5. Machine, as set forth in claim 1, wherein said machine housing comprises a first end located in said first housing and a second end spaced from said first end and located in said second housing, an inlet located in said first end, an outlet located in said first end, a draining section and a presoaking section located in the lower chain section of said first chain, a rinsing section and a clear rinsing section each located in the upper chain section of said first chain with said inlet being arranged to introduce bottles to said first chain for passage initially along said lower chain section while the bottles passing through said upper chain section move from said first chain to the outlet from said machine housing.

6. Device, as set forth in claim 1, wherein said machine housing has an inlet in said first housing and an outlet at the opposite end of said machine housing in said second housing, said first chain in said first housing passes through a draining section followed by individual lye treatment sections including a label removing device, and said second housing comprises a rinsing and clear rinsing section and a cooling section, with said inlet opening into said first housing for introducing bottles initially into said draining section and said outlet opening from said second housing for removing bottles after passage through said cooling section.

7. Device, as set forth in claim 1, wherein said first and second chains each being arranged in the transfer section in position relative to one another so that the bottles carried by one of said first and second chains free-falls from said chain into carrier compartments in the other said chain within said transfer section.

8. Device, as set forth in claim 7, wherein said first and second chains within the transfer section extend obliquely of said upper and lower chain sections for effecting the free-fall of the bottles within said transfer section.

9. Device, as set forth in claim 7, wherein said first and second chains within said transfer section being horizontally arranged one above the other so that the bottles being transferred free-fall from the upper said chain to the lower said chain.

10. Machine, as set forth in claim 1, wherein at least one bottle compartment barrel is located within said transfer section for transferring bottles from one of said first and second chains to the other.

11. Machine, as set forth in claim 1, wherein drain plates are arranged in said transfer section for effecting the movement of the bottles from one of said first and second chains to said outlet from said machine housing.

12. Machine for cleaning bottles containing several treatment sections for cleaning the bottles of residue and for subjecting the bottles to presoaking, main soaking, and clean rinsing, comprising a machine housing having an inlet for introducing bottles to be cleaned and an outlet for discharging cleaned bottles from said machine housing, circulating chains located within said machine housing for conveying the bottles from the inlet to and through the treatment sections and then to the outlet, and means located on said circulating chains for carrying individual bottles, wherein the improvement comprises that said machine housing comprises a first housing, a second housing and a transfer section intercommunicating said first and second housings for passing bottles therebetween, said circulating chains comprise a first endless chain located within said first housing, a second endless chain located within said second housing, said first and second chains being arranged to circulate continuously and being separate from one another with a portion of each of said first and second chains moving through said transfer section, said means for carrying individual bottles comprising carrier compartments mounted on each of said first and second chains, said first and second chains positioned at said transfer section so that bottles supported in said carrier compartments thereon can be transferred in a free-falling manner passing between said first and second chains, and each of said first and second chains having a lower section and an upper section spaced vertically above said lower section, at least one auxiliary chain is located within said transfer section, said auxiliary chain being endless and having a first section extending in parallel with said first chain within said transfer section and a second section extending in parallel with said second chain within said transfer section, a first said auxiliary chain is located within said transfer section adjacent the lower portion of said first and second chains and a second said auxiliary chain is located within said transfer section adjacent said upper chain section of said first and second chains whereby said first auxiliary chain effects transfer of the bottles from said first chain to said second chain and said second auxiliary chain effects transfer of said bottles from said second chain to said first chain.

* * * * *